United States Patent [19]

Holland

[11] 4,281,873

[45] Aug. 4, 1981

[54] FURNITURE UNIT

[75] Inventor: Judith J. Holland, Brampton, England

[73] Assignee: Tarn Textiles Limited, Preston, England

[21] Appl. No.: 90,324

[22] Filed: Nov. 1, 1979

[51] Int. Cl.[3] ..... A47C 13/00

[52] U.S. Cl. ..... 297/118; 297/456; 5/449

[58] Field of Search ..... 297/118, 456, 455, DIG. 3, 297/445; 5/455, 465, 481, 449, 480, 450

[56] References Cited

U.S. PATENT DOCUMENTS

| | | | |
|---|---|---|---|
| 3,761,131 | 9/1973 | Oliver | 297/456 |
| 3,829,918 | 8/1974 | Stamberger | 5/456 |
| 3,893,731 | 7/1975 | Maggs | 297/445 |
| 3,899,210 | 8/1975 | Samhammer et al. | 5/449 |
| 4,011,611 | 3/1977 | Lederman | 5/449 |
| 4,163,297 | 8/1979 | Neumark | 5/455 |
| 4,194,254 | 3/1980 | Torrez | 5/465 |

FOREIGN PATENT DOCUMENTS

| | | | |
|---|---|---|---|
| 404796 | 12/1972 | Australia | 5/465 |
| 946831 | 1/1964 | United Kingdom | 5/455 |

*Primary Examiner*—Francis K. Zugel

*Attorney, Agent, or Firm*—McAulay, Fields, Fisher, Goldstein & Nissen

[57] ABSTRACT

The invention relates to a furniture unit comprising a bed convertible into a seat. The unit comprises a flexible cover containing a deformable filling material such as plastics granules and comprises closure means defining a separate seat portion and a separate bed portion. When the unit is in use as a bed all the filling material is contained within the bed portion of the outer cover but the redundant seat portion remains attached and is conveniently stored in a pocket of the bed. When the unit is in use as a seat all the filling material is contained within the seat portion of the outer cover but the redundant bed portion remains attached and is conveniently held in place by a flap.

9 Claims, 4 Drawing Figures

FURNITURE UNIT

This invention relates to a furniture unit.

More particularly this invention relates to a furniture unit of a type which comprises an outer cover of a flexible material such as a textile or plastics material and an inner filling material which is deformable, for example, plastics granules or textile remnants.

This type of furniture unit has conventionally been used as a seat. In use the inner filling material adapts to the shape of the person using the seat.

The present invention relates to a modification of the type of furniture unit which is adapted for dual use as a seat and as a bed.

Accordingly the present invention provides a furniture unit comprising an outer flexible cover and an inner, deformable filling material, the cover being provided with means adapted to define a seat portion and a bed portion, whereby when the furniture unit is in use as a bed the filling material is contained within the bed portion of the cover and the seat portion is redundant but remains attached and when the furniture unit is in use as a seat the filling material is contained within the seat portion of the cover and the bed portion is redundant but remains attached. Prefereably, the means adapted to define a seat portion and a bed portion are closure means.

The furniture unit according to the invention comprises an outer flexible cover which may be of any suitable material such as platics or textile materials which are conventionally used as upholstery materials. The cover is provided with an opening which may conveniently be provided in the bed portion of the cover through which the whole unit is originally filled with a filling material. The opening may be closed by a zip or like fastening device.

The inner filling material may be any filler or stuffing material conventionally used in furniture units of this type. It is desirable for the filling material to have characteristics which enable easy transference of the material from the bed portion to the seat portion and vice versa. Plastics granules especially polystyrene granules have been found to be particularly suitable for this purpose.

The means adapted to define a seat portion and a bed portion may be any suitable means for dividing the cover into its two portions but is preferably closure means such as press studs or a zip, although in a particularly preferred embodiment of the invention such closure means is provided by a self-sealing closing material. For example, two strips of such a material may be arranged on opposite sides of the internal surface of the cover and may be pressed into mutual contact to provide a sealing line.

The volumes of the two portions of the furniture unit are normally substantially identical since the same volume of filling material is a variable whether the unit is in use as a bed or as a seat. As will be appreciated, the unit is adapted for alternative use as a bed or seat, and may not be used simultaneously as both a bed and seat.

The seat portion of the unit may be simply a round or square bag but according to a preferred embodiment the seat portion is made in the form of an armchair comprising a seat, a back and side arm rests with the seat being raised from the floor.

The bed portion of the unit is elongated and preferably has the shape of a conventional airbed or mattress.

When the unit is in use as a bed the empty and redundant seat portion can be simply tucked under the bed. Alternatively a pocket can be provided in which the redundant seat portion is head. When the unit is in use as a chair the empty and redundant bed is preferably tucked away under the chair and may be held in place by a flap.

In order to transform the unit from a bed to a seat the filling material is shaken from the bed portion to the seat portion. When all the filling material is contained within the seat portion the redundant bed portion is tucked away under the seat and the unit is ready for use as a seat. The reverse procedure is adopted to convert the unit from a seat into a bed. It will be understood that if the furniture unit has closure means, the closure means must be opened to allow transfer of material between the two portions of the unit, and they are then closed again after transfer of the filling into one of the portions.

The invention is further illustrated by the accompanying drawings.

Figure 1:
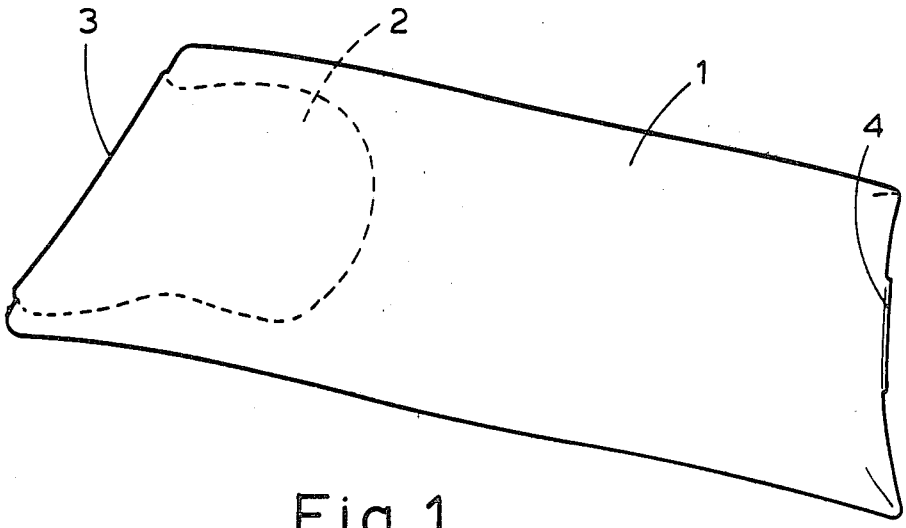
FIG. 1 shows the furniture unit according to the invention in use as a bed.

FIG. 1 illustrates the unit in use as a bed with a bed portion 1 filled. The bed portion 1 is provided at one end 4 with an opening (not shown) closable by a zip for originally filling the unit, and at the opposite end with closure means 3 separating the bed portion 1 from a seat portion 2. In FIG. 1 the seat portion 2 is redundant and is tucked under the bed portion.

Figure 2:
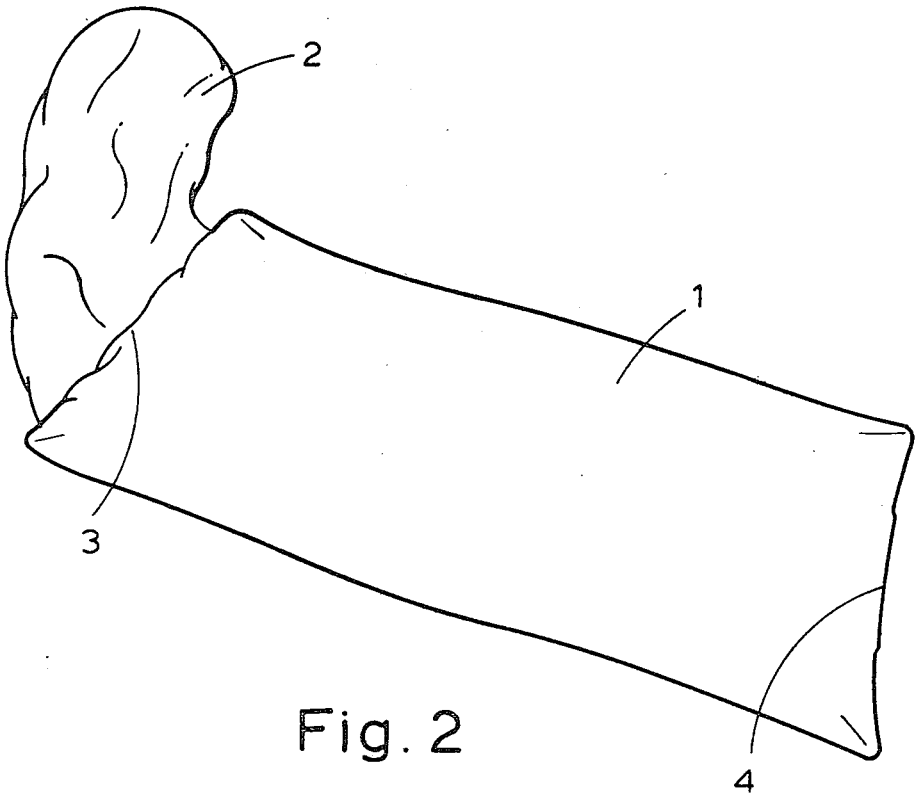
FIG. 2 shows a first stage in the transformation of the unit from a bed to a chair.

In FIG. 2 the redundant seat portion 2 has been removed from under the bed portion 1 preparatory to transforming the unit from a bed to a seat.

Figure 3:
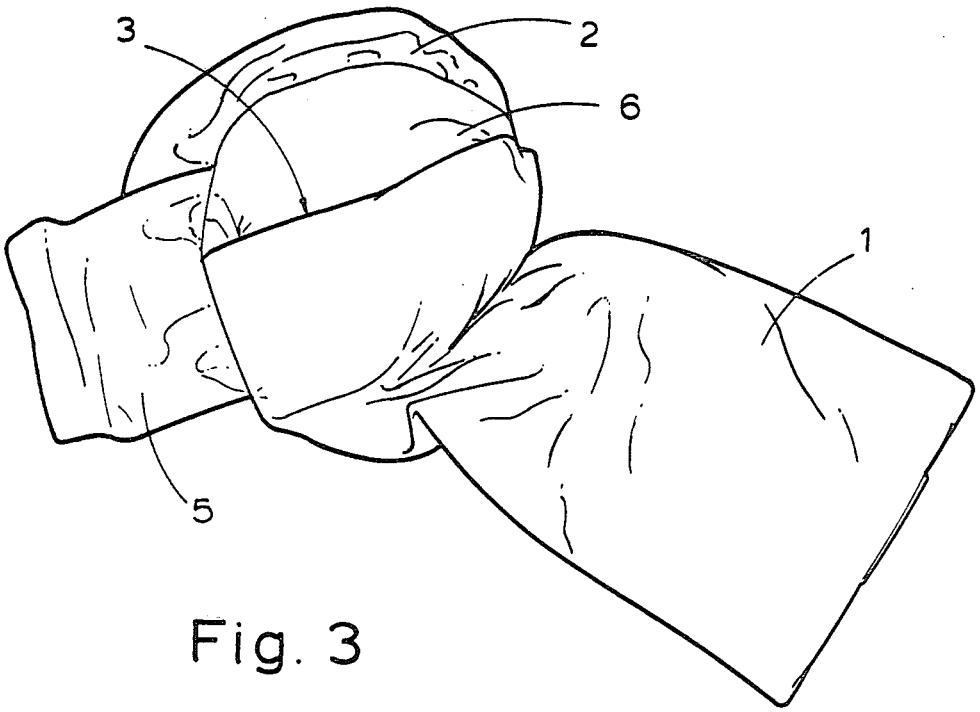
FIG. 3 shows a second stage in the transformation.

In FIG. 3 the closure means 3 has been opened and the filling material (not shown) is shaken from the bed portion 1 to the seat portion 2. When all the filling material is contained in the seat portion 2 the closure means 3 are closed and the redundant bed portion is then folded and held in place by means of a flap 5 located on the underside 6 of the seat portion.

Figure 4:
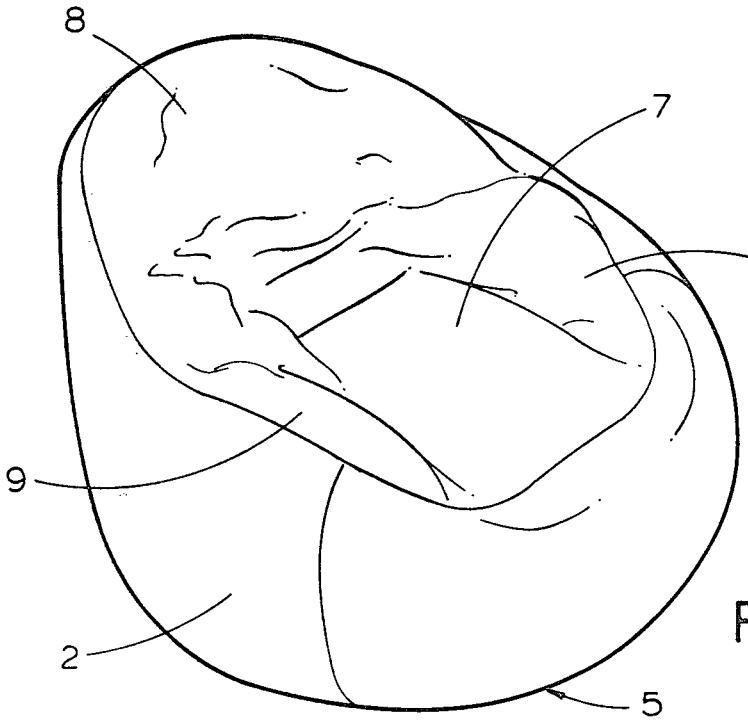
FIG. 4 shows the furniture unit in use as a chair.

In FIG. 4 the transformation is complete with the unit in use as a seat with the bed portion being tucked out of sight under the seat portion 2 and held in place by the flap 5. The seat unit comprises a seating section 7, a back 8 and arm mouldings 9.

The unit can, if desired, also include a loose cover which is removable for cleaning:

The unit according to the invention thus provides a convenient chair and bed which is simple to manufacture and which is economical in terms of both money and space.

What I claim is:

1. A furniture unit comprising an outer inflatible fillable cover, said cover comprising a portion shaped to form a seat and backrest when filled and a separate and distinct porton shaped to form a bed when filled connected to one end of said seat portion, a passage communicating with the interior of said bed and seat portions, deformable filling material in said cover movable between said seat and bed portions, and selectively operable closure means in said passage for closing said passage to prevent movement of said filling material from one portion to the other portion.

2. A furniture unit as in claim 1, in which the volumes of said bed and seat portions are substantially equal.

3. A furniture unit as claimed in claim 1 wherein the deformable filling material comprises plastics granules.

4. A furniture unit as claimed in claim 3, wherein the plastics granules are polystyrene granules.

5. A furniture unit as claimed in claim 1, wherein the closure means is provided by a self-sealing closing material.

6. A furniture unit as claimed in claim 1, wherein the seat portion is in the form of an armchair comprising a raised seat, a back and side arm rests.

7. A furniture unit as claimed in claim 1, wherein the bed portion is elongated.

8. A furniture unit as claimed in claim 1, wherein the unit comprises a pocket for storing the redundant seat portion when the unit is in use as a bed.

9. A furniture unit as claimed in claim 1, which comprises a flap for holding in position the redundant bed portion when the unit is in use as a seat.

* * * * *